US005793585A

United States Patent [19]

Cowan

[11] Patent Number: 5,793,585

[45] Date of Patent: Aug. 11, 1998

[54] IGNITOR CIRCUIT ENHANCEMENT

[76] Inventor: Thomas L. Cowan, P.O. Box 956, Cutchoque, N.Y. 11935

[21] Appl. No.: 767,218

[22] Filed: Dec. 16, 1996

[51] Int. Cl.[6] ..... F23Q 3/00

[52] U.S. Cl. ..... 361/1; 361/253

[58] Field of Search ..... 361/112, 247, 361/251, 253, 257, 263; 123/620, 621, 622

[56] References Cited

U.S. PATENT DOCUMENTS

| | | | |
|---|---|---|---|
| 3,646,922 | 3/1972 | Spalding | 123/117 A |
| 3,974,412 | 8/1976 | Pratt, Jr. | 313/131 R |
| 4,033,316 | 7/1977 | Birchenough | 123/148 E |
| 4,122,816 | 10/1978 | Fitzgerald et al. | 123/148 DC |
| 4,124,003 | 11/1978 | Abe et al. | 123/119 E |
| 4,327,701 | 5/1982 | Gerry | 123/598 |
| 4,369,758 | 1/1983 | Endo | 123/620 |
| 4,457,285 | 7/1984 | Hamai et al. | 123/598 |
| 4,510,915 | 4/1985 | Ishikawa et al. | 123/620 |
| 4,672,928 | 6/1987 | Hartig | 123/143 B |
| 4,677,960 | 7/1987 | Ward | 123/598 |
| 4,969,432 | 11/1990 | Schamweber et al. | 123/143 B |
| 4,996,967 | 3/1991 | Rosswurm et al. | 123/620 |
| 5,471,362 | 11/1995 | Cowan | 361/257 |

*Primary Examiner*—Sally C. Medley
*Attorney, Agent, or Firm*—Scully, Scott, Murphy & Presser

[57] ABSTRACT

A power arc circuit having a high voltage power source connected to the power arc circuit downstream of a high voltage, high current diode and by a relay between a power input and the power arc circuit.

5 Claims, 2 Drawing Sheets

IGNITOR CIRCUIT ENHANCEMENT

BACKGROUND OF THE INVENTION

This invention relates to ignition systems and of the kind used to ignite fuel oil burners using energy determined by capacitor breakdown for creating an ignition arc at a sparking device, i.e. a spark plug.

The typical environment for use of this invention is for systems that are used to ignite extremely dirty fuels. In such system the fuel can tend to mask the conductive path of the sparking device electrodes which is normally facilitated in the prior art by use of semiconductor material between electrodes of the sparking device or by the creation of a current path of low voltage potential whereby the space about the electrodes becomes ionized to lower resistance creating a grounding path and thereby allowing rapid discharge between the electrodes so as to provide a hot arc for fuel ignition.

It has been discovered that a film of fuel in this area covering the electrodes can prevent the creation of the current path establishing the ionized area.

The principle object of this invention is, therefore, to provide a secondary power source for such power arc circuits that will allow the creation for the ionized area about the sparking devices electrodes in the event that a film of fuel has created a contaminant layer about these electrodes.

BRIEF SUMMARY OF THE INVENTION

In accordance with the invention a conventional capacitive discharge ignition system is improved with the addition of a power source and a diode means that are adapted to be connected thereto to preclude operation of the system unless current is flowing from the power source to overcome contamination by keeping a potential at a spark plug in the ignition system.

DETAILED DESCRIPTION

Figure 1:
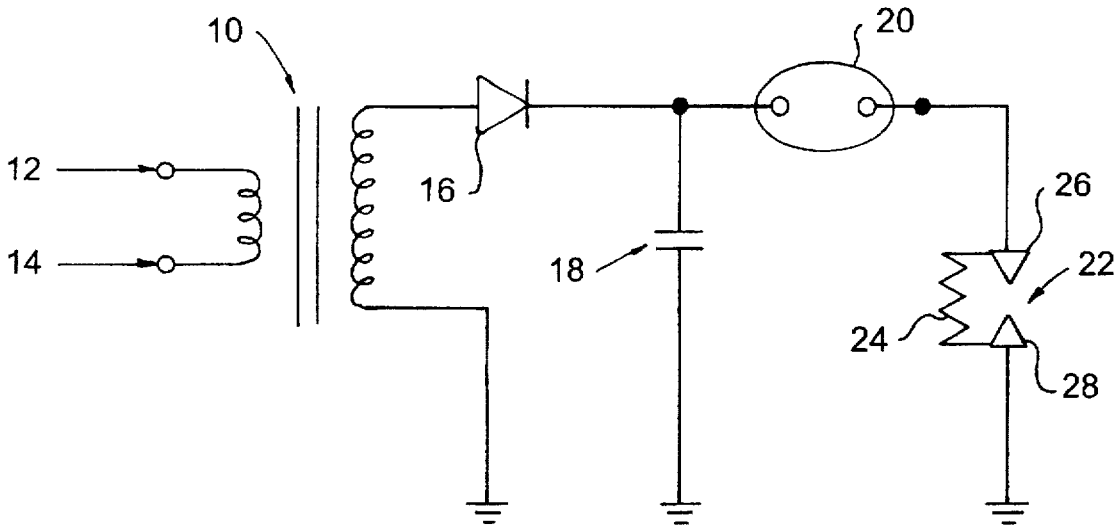
FIG. 1 (PRIOR ART)
FIG. 1 is a circuit diagram of one form for a power arc circuit of the prior art.

In the prior art circuit of FIG. 1, a transformer 10 produces a 2000 RMS AC voltage with a normal 120 or 220 input at 12 and 14. This voltage is rectified by diode 16 and charges a capacitor 18. The output of capacitor 18 is communicated to spark gap device 20 whose output is connected to sparking device 22 of the type as shown as prior art in my earlier U.S. Pat. No. 5,471,362 having a semiconductor material 24 between the two electrodes 26 and 28 to allow current flow to ionize the space about the electrodes for the purposes as aforesaid.

Figure 2:
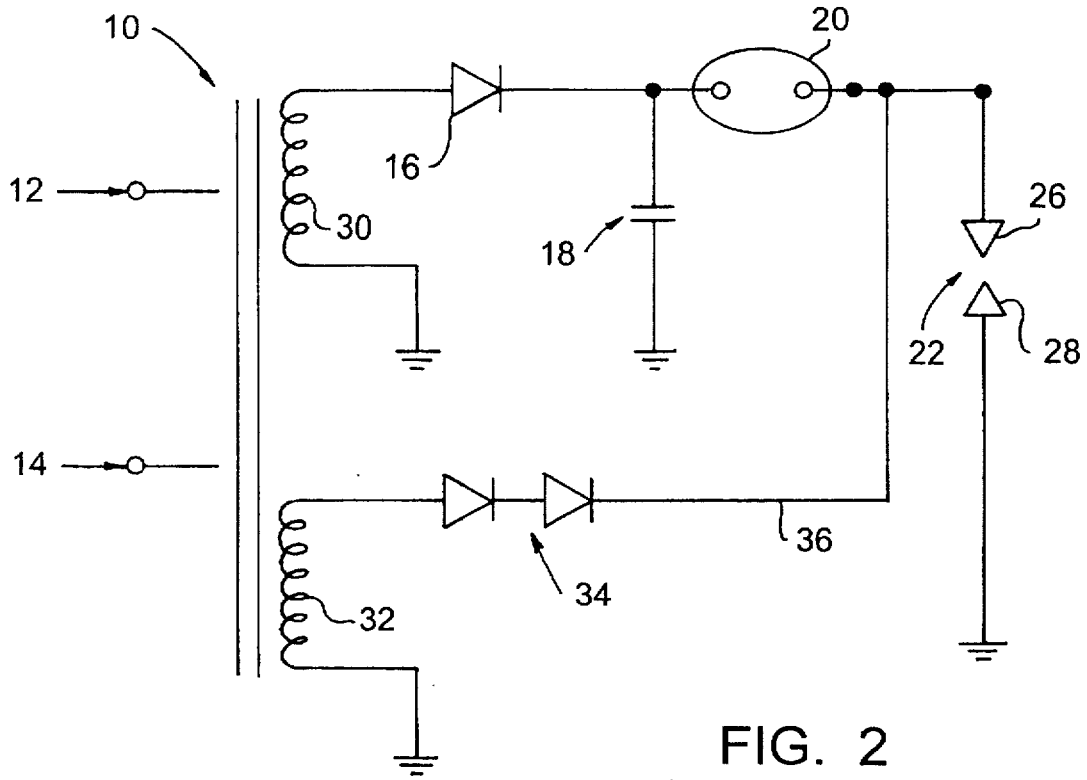
FIG. 2 (PRIOR ART)
FIG. 2 is another circuit diagram of another form for a power arc circuit of the prior art.

In the prior art circuit of FIG. 2 also shown and described in my earlier patent the transformer 10 is divided so as to have a primary 30 and secondary 32 voltage source with the secondary, being a high voltage secondary winding that will produce 5000 volt AC that is rectified by high voltage diodes 34 to a 5000 plus volt DC potential communicated by line 36 to produce a current path across electrodes 26 and 28 of sparking device 22. This will ionize the air thereabout to create current flow as in the use of the semiconductive material in the device of FIG. 1. This will provide an actual voltage drop between electrode 26 and electrode 28 which will be maintained at a low voltage level on the order of a few hundred volts.

The purpose of the semiconductive material between the spark plug's electrodes or the secondary source's current flow being to ensure low resistance to current flow through a defined conducting path so that capacitor 18 may rapidly discharge in a short time duration to produce a hot arc.

Figure 3:
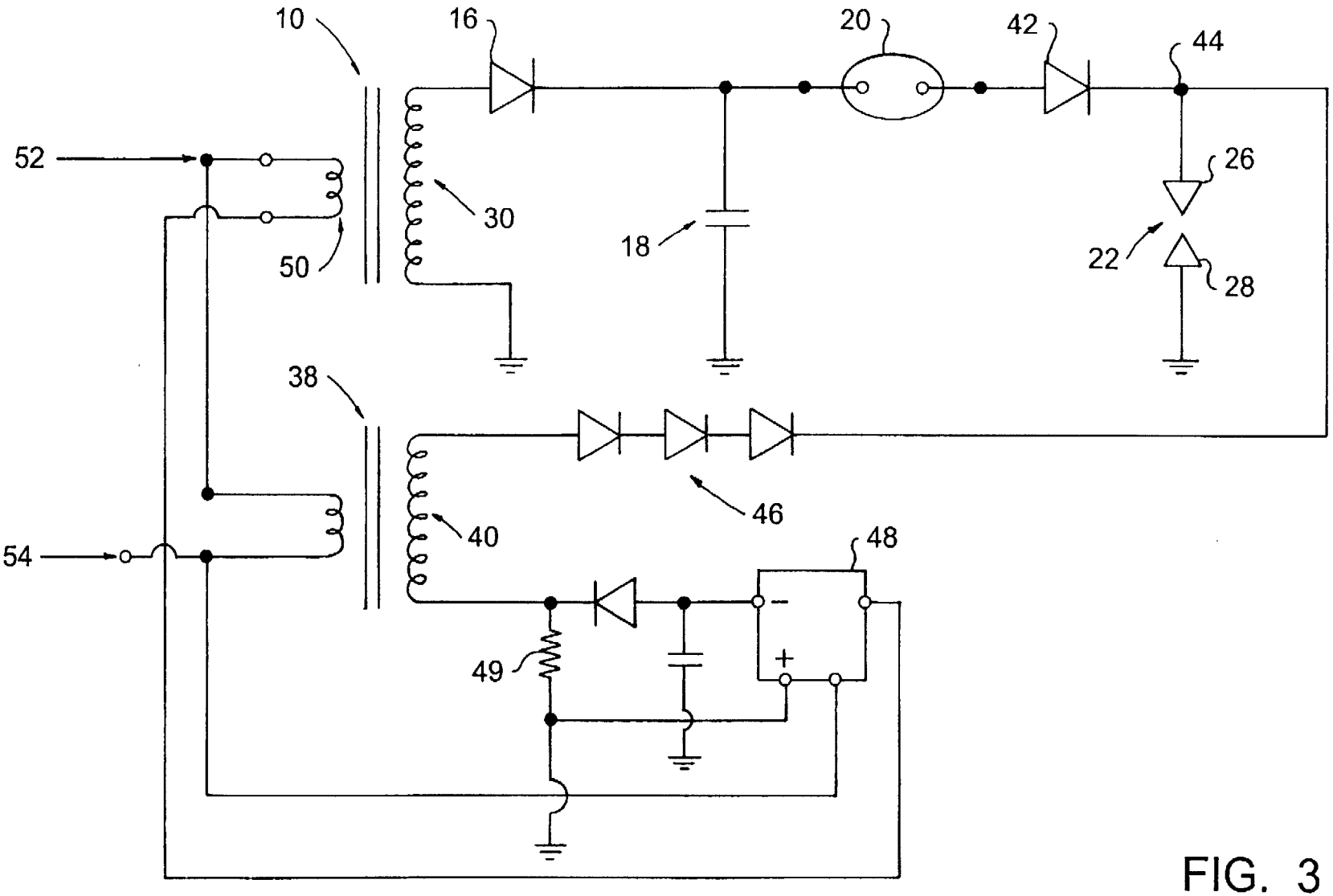
FIG. 3 is a circuit diagram of the high voltage circuit of the present invention.

In the utilization of either of the power art circuits described above it has been observed that fuel could mask the surface about the electrodes 26 and 28 preventing the creation of the ionized low resistance current path, and that a solution to this interference with establishing an ignition arc would be to modify the CORONA ARC CIRCUIT as depicted by my earlier U.S. Pat. No. 5,471,362, and particularly the system or circuit shown thereby having primary (2000 VAC) and secondary (5000 VAC) transformers by using a secondary transformer 38 (See FIG. 3) having qualities that would facilitate the breakdown of contaminates with a high voltage output between 7 KV and 14 KV. As a result and with reference to FIG. 3 a blocking diode 42 has been incorporated between spark gap 20 and sparking device 22 upstream of the connection 44 of the high voltage rectifying network 46 from secondary winding 40 to protect the basic power arc circuit from this higher voltage.

Instead of a 60 cycle ignition transformer 38 rectified by diode network 46 one could have a solid state ignition transformer (not shown) with means to rectify its output like the network 46. This would provide both a high voltage between 7 KV and 14 KV, as before, at a high frequency of about 20 KHz. This would allow the use of a high frequency current inherent in the solid state ignition transformer to aid in breaking through contamination at 22.

It was also observed that further improvements to such a system could be realized by incorporating a solid state relay device 48 that will, upon sensing current flow from transformer 38, complete the input to the primary transformer's primary winding 50 so that, if the electrodes 26 are totally immersed in fuel, the absence of current flow shuts down primary transformer 10 until the high voltage potential across electrodes 26 and 28 breaks through the fuel barrier at which time the high pulsating currents will continue to reinstate via relay 48 the power arc circuit.

The circuit receives its 110 or 220V power at terminals 52 and 54.

Having now set forth the environment and operative construction of an embodiment that embraces the concept of the invention it is now desired to set forth the scope of protection to be afforded by this patent in the appended claims.

I claim:

1. A means to adapt a power are circuit of a fuel ignitor system so as to preclude fuel contamination from interfering with conduction of an ignition arc across an established current path between electrodes as scheduled by a spark gap device in the system, said means comprising:

a power input;

a first high voltage transformer having a primary winding connected to the power input and a secondary winding with said secondary winding terminating in a first end and a second end;

first means connecting said second end to the power input for the power arc circuit;

second means connecting said first end of said first high voltage transformer secondary winding to one of the electrodes via a spark gap device in the power arc circuit;

diode means connected between said spark gap device and said one of the electrodes;

third means including a second high voltage transformer and a high voltage rectifying network connected downstream of the diode means such that said diode means will prevent reverse current in the power arc circuit; and fourth means connecting said third means to the primary winding of said first high voltage transformer to preclude operation for the power arc circuit in absence of current flow in said third means.

2. The means of claim 1 wherein said fourth means comprises a solid state switch circuit connected between said primary winding of said first high voltage transformer and a ground potential for controlling operation of the power arc circuit as a function of current flow from said secondary winding of said second high voltage transformer.

3. The means of claim 2 and further comprising a means connecting said second high voltage transformer with said sold state switch circuit including a grounded resistor circuit and a grounded diode capacitor circuit with said solid state switch circuit having a terminal connected between the primary winding of said first high voltage transformer and said power input.

4. The means of claim 1 wherein said second high voltage transformer is characterized as a 60 cycle ignition transformer supplying high voltage to the high voltage rectifying network.

5. The means of claim 1 wherein said second high voltage transformer is characterized as a solid state ignition transformer supplying a high voltage, high frequency current to the high voltage rectifying network.

* * * * *